US005304740A

United States Patent [19]

Bozell et al.

[11] Patent Number: 5,304,740

[45] Date of Patent: Apr. 19, 1994

[54] FUSIBLE LINK WIRE

[75] Inventors: David A. Bozell, Ft. Wayne; Eric W. Bates, Lafayette, both of Ind.

[73] Assignee: Essex Group, Inc., Fort Wayne, Ind.

[21] Appl. No.: 796,049

[22] Filed: Nov. 20, 1991

[51] Int. Cl.[5] ..... H01B 7/00

[52] U.S. Cl. ..... 174/110 PM; 174/110 V; 174/121 A; 174/121 SR; 174/122 G; 174/122 C; 337/414; 337/415

[58] Field of Search ..... 174/110 PM, 110 V, 121 R, 174/121 A, 121 SR, 122 R, 122 G, 122 C; 337/414, 415

[56] References Cited

U.S. PATENT DOCUMENTS

| | | | |
|---|---|---|---|
| 1,458,803 | 6/1923 | Burley et al. | 174/121 R |
| 2,007,761 | 7/1935 | Kaimer | 174/121 A |
| 2,125,836 | 8/1938 | Olson | 174/121 A |
| 2,320,201 | 5/1943 | Szilard | 174/121 A |
| 2,391,931 | 1/1946 | Swartz et al. | 174/121 R |
| 2,581,212 | 1/1952 | Spooner, Jr. et al. | 219/46 |
| 2,750,437 | 6/1956 | Olson et al. | 174/110 R |
| 3,576,940 | 5/1971 | Stone et al. | 174/121 A |
| 3,828,119 | 8/1974 | Warburton et al. | 174/121 A |
| 3,878,497 | 4/1975 | Spangler | 337/295 |
| 4,145,475 | 3/1979 | Vostovich | 174/110 PM |
| 4,869,972 | 9/1989 | Hatagishi | 428/647 |

*Primary Examiner*—Morris H. Nimmo
*Attorney, Agent, or Firm*—Mark F. Smith

[57] ABSTRACT

A fusible link wire for use in an electric circuit comprising a fusible conductor for opening the circuit in response to a given current level, an inner electrical insulation layer surrounding the fusible conductor, a braided sheath positioned over the inner electrical insulation layer for increasing the structural strength of the insulation layer and for holding the inner electrical insulation layer in place in the event of a failure, and an outer protective coating surrounding the sheath and the inner electrical insulation layer for holding the sheath in place during handling or processing of the fusible link wire and for providing protection against the environment.

9 Claims, 1 Drawing Sheet

FUSIBLE LINK WIRE

BACKGROUND OF THE INVENTION

This invention relates to a fusible link wire, and more particularly, to a fusible link wire especially adaptable for use as a low tension cable found in automotive electrical harnesses.

Fusible link wire is an overcurrent protection device for an electrical circuit that utilizes a conductor which is generally two to four AWG wire sizes smaller or has a higher relative resistance than the other conductors in the electrical circuit. Fusible link wires commonly comprise a central electrical conductor, such as stranded copper, tin-coated copper, brass, copper-nickel alloys or other similar metals, surrounded by a thermosetting electrical insulation typically made from chlorosulfonated polyethylene, having relatively good insulating properties and resistance to heat and the adverse chemical environment present in the vicinity of an automobile engine.

In operation, when a conducting electrical circuit having a fusible link wire is placed under extreme overload conditions, the temperature of the smaller fusible link conductor increases more rapidly than the conductors of the other wires in the circuit. This relatively rapid temperature rise continues until the conductor melts and opens the conducting circuit. Previous prior art fusible link wires, however, have been found to be unsatisfactory. The rapid heating of the conductor and the insulation typically produces inflammable gasses which become trapped along the surface of the conductor and can ignite at the high temperatures encountered during the overload conditions. Furthermore, when the insulation degrades, or otherwise breaks down and fails, an exposed, energized conductor or energized-conductor end can result, creating an unacceptable operating condition.

Consequently, a need exists for a fusible link wire comprising a conductor having excellent electrical conductivity characteristics and a high temperature electrical insulation which is abrasion and chemical resistant, high temperature cut-through resistant, and resistant to aging. Furthermore, the insulation should be highly resistant to physical breakdown, flame retardant and permit the rapid dispersion of gasses.

SUMMARY OF THE INVENTION

The present invention is directed to a fusible link wire for use in an electric circuit comprising a fusible conductor for opening the circuit in response to a given current level, an inner electrical insulation layer surrounding the fusible conductor, a braided sheath positioned over the inner electrical insulation layer for increasing the structural strength of the insulation layer, and an outer protective coating surrounding the sheath and the inner electrical insulation layer for holding the sheath in place during handling or processing of the fusible link wire and for providing protection against the environment.

In operation, the fusible link wire is suitably connected between the adjacent ends of a conductor in an electric circuit. In response to an extreme overload or high current fault, the temperature of the fusible conductor rapidly rises until the conductor melts and opens the electric circuit. During this rapid temperature rise, the degrading inner electrical insulation layer radially expands until it ruptures and allows any inflammable gasses which may have formed along the surface of the fusible conductor, to dissipate. The ruptured electrical insulation layer is held in place by the braided sheath, which significantly reduces the risk of an exposed energized conductor or energized-conductor end. In addition, the outer protective coating melts and readily marks the area of failure.

A primary object of this invention, therefore, is to provide an improved fusible link wire.

Another primary object of this invention is to provide an improved fusible link wire for use in protecting wire harnesses found in automotive electrical circuits.

Another primary object of this invention is to provide an improved fusible link wire which permits the dissipation of gasses during extreme overload conditions.

Another primary object of this invention is to provide an improved fusible link wire which will not expose an energized conductor or an energized-conductor end upon failure.

Another primary object of this invention is to provide an improved fusible link wire which clearly marks the location of failure.

Another primary object of this invention is to provide an improved fusible link wire having good flame, abrasion, chemical resistance, oil resistance, high temperature cut-through, and long term temperature characteristics.

Other objects and advantages of the invention will be apparent from the following description, the accompanying drawing and the appended claims.

DETAILED DESCRIPTION OF THE PREFERRED EMBODIMENT

Figure 1:
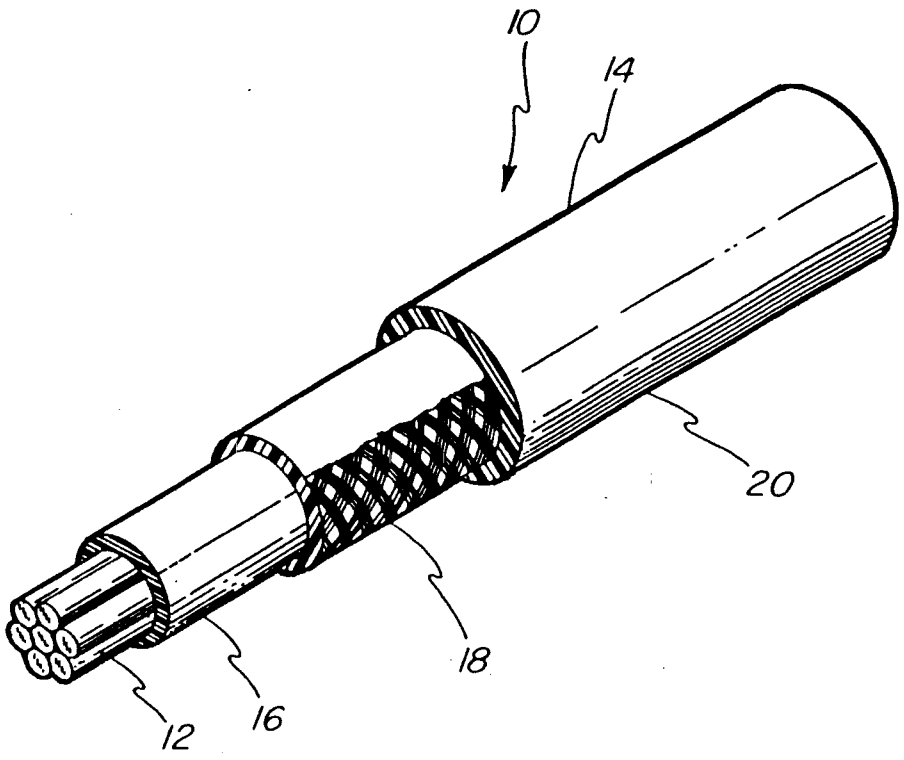
FIG. 1 is a perspective view of the fusible link wire constructed in accordance with the invention with portions thereof cut away for the purpose of better illustrating its construction and showing the features of the invention.

Referring to the perspective view set forth in FIG. 1, a composite fusible link wire 10 is shown having a central fusible electrical conductor 12 surrounded by an insulation jacket 14. The jacket 14 preferably comprises an inner electrical insulation layer 16, a braided or woven sheath 18 surrounding the external surface of the inner electrical insulation layer 16, and an outer protective coating 20.

The fusible conductor 12 typically is formed from copper, tinned copper, silver plated copper, aluminum, brass, copper-nickel alloys or other similar metals in the form of a stranded conductor, as shown, or in the form of a solid conductor. In general, conductors for fusible link wire may range in size from No. 22 to No. 6 AWG having a diameter of about 0.79 mm to about 5.06 mm.

The primary insulation material comprising the inner electrical insulation layer 16 preferably is a chlorinated polyethylene polymer (CPE), which is commercially available from several sources. However, the primary insulation material of the inner electrical insulation layer may also comprise other semi-permeable, thermosetting materials, such as chlorsulfonated polyethylene, which is commercially available from one manufacturer, for example, under the trademark HYPALON.

The insulation material selected is preferably cross-linked and may include conventional additives to improve its physical properties, such as chemical and oil resistance, flame resistance, high temperature cut through resistance and temperature rating (preferably at least 105 C.). The inner electrical insulation layer 16 has a preferred nominal wall thickness of about 0.2 to 2.5 mm.

A composition, which has been found to be particularly suitable for use as the inner electrical insulation layer 16, comprises:

| | | |
|---|---|---|
| 36% Chlorine CPE polymer (Parachlor 200) | 100.0 pph polymer | |
| Triallyl Cyanurate | 2.0 pph polymer | (curing coagent) |
| Organic Peroxide | 3.0 pph polymer | (curing agent) |
| Vinyl Silane | 1.0 pph polymer | (coupling agent) |
| 80% Dibasic Lead Phthalate dispersion | 12.5 pph polymer | (activator and curing agent) |
| Antimony Oxide (80% dispersion in EPDM) | 10.0 pph polymer | (flame retardant) |
| Hydrated Alumina | 45.0 pph polymer | (flame retardant) |
| Dilauryl Thiodipropionate | 1.0 pph polymer | (anti-oxidant - heat resistance) |
| Phenolic Antioxidant | 2.0 pph polymer | (anti-oxidant - heat resistance) |
| Talc | 5.0 pph polymer | (filler) |
| pH Balanced Clay | 45.0 pph polymer | (filler) |
| Calcium Carbonate | 22.5 pph polymer | (filler) |
| Trioctyl Trimellitate | 35.0 pph polymer | (plasticizer & softener) |

Another composition, which has been found to be particularly suitable for use as the inner electrical insulation layer 16, comprises:

| | | |
|---|---|---|
| Chlorsulfonated Polyethylene polymer (Hypalon 40) | 100 pph polymer | |
| Triallyl Cyanurate | 2.0 pph polymer | (curing coagent) |
| Organic Peroxide | 3.5 pph polymer | (curing agent) |
| Magnesium Oxide | 10.0 pph polymer | (activator and curing agent) |
| Pentaerythritol | 3.0 pph polymer | (activator and curing agent) |
| Decabromo Diphenyl Oxide | 30.0 pph polymer | (flame retardant) |
| Antimony Oxide (80% dispersion in EPDM) | 15.0 pph polymer | (flame retardant) |
| Chlorinated Paraffin Oil | 13.0 pph polymer | (plasticizer & flame retardant) |
| Dilauryl Thiodipropionate | 1.0 pph polymer | (anti-oxidant - heat resistance) |
| Phenolic Antioxidant | 1.0 pph polymer | (anti-oxidant - heat resistance |
| Calcium Stearate | 0.8 pph polymer | (lubricant) |
| Paraffin Wax | 3.0 pph polymer | (lubricant) |
| Calcined Clay | 60.0 pph polymer | (filler) |

The braided sheath 18, which is somewhat similar to a finely woven net, is positioned over the external surface of the insulation layer 16 to increase its structural strength. The sheath 18 is preferably made from threads or filaments of glass fiber having a preferred braid range of about 2.8 to 8.0 picks/cm. However, other high temperature, braided materials having relatively high strength and high temperature characteristics may be used. In the event of an extreme overload or high current fault, the sheath 18 allows the inner electrical insulation layer 16 to expand and rupture to permit the dissipation of gasses. In addition, the sheath 18 operates to hold the inner electrical insulation layer 16 in place to reduce the danger of an exposed energized conductor or energized-conductor end.

The outer protective coating 20 surrounding the braided sheath 18 and insulation layer 16, comprises a flame retardant thermoplastic compound having a limiting oxygen index of at least 27. One such family of compounds is flexible polyvinyl chloride (PVC), which is a well known material and readily available. However, other commonly used thermoplastic coating materials, such as a flame retardant polyethylene, are suitable. The outer protective coating 20 has a preferred nominal wall thickness of about 0.1 to 1.2 mm and operates to hold the sheath 18 in place during any handling or processing that may occur such as during fabrication of an automotive electrical harness. In addition, the inherent characteristics of PVC, such as oil and chemical resistance, provide protection for the sheath 18 and the inner electrical insulation layer 16 against the adverse chemical environment present in the vicinity of an automobile engine. During an extreme overload condition, the outer protective coating 20 will melt and flow away from the location of the failure, thereby allowing the dissipation of gasses from the ruptured inner electrical insulation and clearly marking the location of the failure. Where desired, the outer protective coating may also contain a coloring pigment or dye for the purpose of color-coding.

A composition, which has been found to be particularly suitable for use as the outer protective coating 20, is a thermoplastic flexible polyvinyl chloride compound comprising (by weight) 56.50% resin, 0.34% paraffin wax as a lubricant, 1.13% antimony oxide (flame retardant), 4.07% lead stabilizer, 20.11% trioctyl trimellitate (plasticizer), 8.13% diundecyl phthalate (plasticizer), 4.07% partially calcined clay (filler), and 5.65% calcium carbonate (filler).

Numerous tests conventional in evaluating wire of this type were conducted. The fusible link wire made in accordance with this invention at least satisfied all of the tests set forth in SAE J1128 (1991) for this type HTS or STS wire.

In operation, the fusible link wire is suitably connected between the adjacent ends of a conductor in an electrical circuit (not shown). The size of the fusible link wire is selected such that the fusible conductor is two to four AWG wire sizes smaller than the wire size of the circuit or has a higher relative resistance than the other conductor(s) in the circuit. In response to an extreme overload or high current fault, the temperature of the fusible conductor increases more rapidly than the temperature of the other conductor(s) in the electrical circuit. This relatively rapid temperature rise continues until the fusible conductor melts (approximately 870 C. for a copper conductor) and opens the electrical circuit. During this rapid temperature rise, inflammable gasses form along the surface of the fusible conductor. When the temperature of the conductor exceeds about 200 C., the insulation jacket begins to degrade. The increasing pressure exerted on the degrading inner electrical insulation layer by the forming inflammable gasses causes the layer to radially expand through the surrounding sheath until the inner electrical insulation layer ruptures in a "zipping" fashion and permits the dissipation of the inflammable gasses away from the high temperature of the conductor. The sheath operates to hold the ruptured inner electrical insulation layer in place and reduces the risk of an exposed energized conductor or energized-conductor end. As heat is transferred outwardly from the failed conductor, the temperature of the inner electrical insulation layer increases, exceeding the melting point of the outer protective coating (approximately 170 C. for flexible PVC), the outer protective coating will melt and flow away from the point of failure. This further facilitates the dissipation of the gasses and readily marks the area of failure.

While the product herein described constitute preferred embodiments of the invention, it is to be understood that the invention is not limited to this precise product, and that changes may be made therein without departing from the scope of the invention which is defined in the appended claims.

What is claimed is:

1. A fusible link wire for use in an electric circuit comprising:

a fusible conductor for opening the electric circuit in response to a given current level;

an inner electrical insulation layer surrounding said fusible conductor, said inner electrical insulation layer comprising a crosslinked polyethylene compound having a temperature rating of at least 105 C. and a limiting oxygen index of at least 27;

a braided sheath positioned over said inner electrical insulation layer for increasing the structural strength of said inner electrical insulation layer; and an outer protective coating surrounding said sheath and said inner electrical insulation layer for securing said sheath in position, said outer protective coating comprising a polyvinyl chloride having a limiting oxygen index of at least 27.

2. A fusible link wire as claimed in claim 1 wherein said crosslinked polyethylene compound is a chlorinated polyethylene compound.

3. A fusible link wire as claimed in claim 1 wherein said crosslinked polyethylene compound is a chlorosulphonated polyethylene compound.

4. A fusible link wire as claimed in claim 1 wherein said electrical insulation means comprises an inner electrical insulation layer surrounding said fusible conductor means, said inner electrical insulation layer is a semipermeable material.

5. A fusible link wire as claimed in claim 4 wherein said electrical insulation layer comprising about 100.0 pph polymer of a 36% chlorine CPE polymer; triallyl cyanurate, about 2.0 pph polymer; organic peroxide, about 3.0 pph polymer; vinyl silane, about 1.0 pph polymer; about 80% dibasic lead phthalate dispersion, about 12.5 pph polymer; antimony oxide 80% dispersion in EPDM, about 10.0 pph polymer; hydrated alumina, about 45.0 pph polymer; dilauryl thiodipropionate, about 1.0 pph polymer; phenolic antioxidant, about 2.0 pph polymer; talc, about 5.0 pph polymer; pH balanced clay, about 45.0 pph polymer; calcium carbonate, about 22.5 pph polymer; and trioctyl trimellitate, about 35.0 pph polymer.

6. A fusible link wire as claimed in claim 4 wherein said inner electrical insulation comprises:

100.0 pph polymer chlorsulfonated polyethylene; triallyl cyanurate, about 2.0 pph polymer; organic peroxide, about 3.50 pph polymer; magnesium oxide, about 10.0 pph polymer; pentaerythritol, about 3.0 pph polymer; decabromo diphenyl oxide, about 30.0 pph polymer; antimony oxide about 80% dispersion in EPDM, about 15.0 pph polymer; chlorinated paraffin oil, about 13.0 pph polymer; dilauryl thiodipropionate, about 1.0 pph polymer; phenolic antioxidant, about 1.0 pph polymer; calcium stearate, about 0.8 pph polymer; paraffin wax, about 3.0 pph polymer; and calcined clay, about 60.0 pph polymer.

7. A fusible link wire as claimed in claim 1 wherein said sheath is braided glass fibers.

8. A fusible link wire as claimed in claim 1 wherein said outer protective coating is a flexible polyvinyl chloride compound comprising about 56.5% resin by weight; about 0.34% by weight paraffin wax; about 1.13% by weight antimony oxide; about 4.07% by weight lead stabilizer; about 20.11% by weight trioctyl trimellitate; about 8.13% by weight diundecyl phthalate; about 4.07% by weight partially calcined clay; and about 5.65% by weight calcium carbonate.

9. A fusible link wire as claimed in claim 1 wherein said inner electrical insulation layer having a nominal wall thickness of about 2 to about 2.5 mm, said braided sheath comprises glass fiber having a braid range of about 2.8 to about 8.0 picks/cm, and said outer protective coating having a nominal wall thickness of about 0.1 to about 1.2 mm.

* * * * *